US011940256B2

(12) United States Patent
Nemec

(10) Patent No.: US 11,940,256 B2
(45) **Date of Patent: *Mar. 26, 2024**

(54) ADVANCED MODULAR AMMUNITION AND CARTRIDGES AND SYSTEMS

(71) Applicant: William Joseph Nemec, Pittsburgh, PA (US)

(72) Inventor: William Joseph Nemec, Pittsburgh, PA (US)

( * ) Notice: Subject to any disclaimer, the term of this patent is extended or adjusted under 35 U.S.C. 154(b) by 148 days.

This patent is subject to a terminal disclaimer.

(21) Appl. No.: 17/581,900

(22) Filed: Jan. 22, 2022

(65) Prior Publication Data

US 2022/0146239 A1 May 12, 2022

Related U.S. Application Data

(63) Continuation of application No. 16/195,700, filed on Nov. 19, 2018, now Pat. No. 11,300,388, which is a (Continued)

(51) Int. Cl.

| | |
|---|---|
| ***F42B 5/02*** | (2006.01) |
| ***F42B 5/26*** | (2006.01) |
| ***F42B 5/285*** | (2006.01) |
| ***F42B 5/307*** | (2006.01) |
| ***F42B 5/32*** | (2006.01) |

(Continued)

(52) U.S. Cl.

CPC ..... *F42B 5/02* (2013.01); *F42B 5/26* (2013.01); *F42B 5/285* (2013.01); *F42B 5/307* (2013.01); *F42B 5/32* (2013.01); *F42B 8/12* (2013.01); *F42B 12/02* (2013.01); *F42B 12/74* (2013.01); *F42B 12/745* (2013.01); *F42B 12/76* (2013.01); *F42B 30/02* (2013.01);

(Continued)

(58) Field of Classification Search

CPC .... F42B 5/00; F42B 5/02; F42B 5/045; F42B 5/067; F42B 5/073; F42B 5/26; F42B 5/28; F42B 5/285; F42B 5/30; F42B 5/307; F42B 5/313; F42B 8/12; F42B 12/02; F42B 12/74; F42B 12/745; F42B 12/76; F42B 30/02; F42C 19/08; F42C 19/10; F42C 19/0826; F42C 19/083

USPC ..... 102/430, 439, 444, 447, 469, 470

See application file for complete search history.

(56) References Cited

U.S. PATENT DOCUMENTS 4,391,199 A * 7/1983 Morin ..... F42B 8/02 102/374

4,782,758 A * 11/1988 Washburn ..... F42B 5/045 102/434

(Continued)

*Primary Examiner* — James S Bergin

(74) *Attorney, Agent, or Firm* — Thomas Lizzi, Esq.

(57) ABSTRACT

Modular cartridges are disclosed that can be initially assembled, disassembled, and reprocessed by hand. The cartridge case is suitable for use with a variety of projectile designs and weights and for use with a range of propellant amounts and primer types. The variety of projectiles and range of propelling forces permits the present invention to provide cartridges for all types of uses, including indoor and outdoor target shooting, training, non-lethal self-protection, and lethal uses. The cartridges include a case, a projectile, a primer, and a selectable amount of propellant (if any), and primer housing insert" and which is configured to be releasably attached to the striking end of the case and to contain the primer and the desired amount of propellant.

20 Claims, 11 Drawing Sheets

Related U.S. Application Data continuation of application No. 14/775,630, filed on Sep. 11, 2015, now Pat. No. 10,132,601.

(51) Int. Cl.

| | |
|---|---|
| ***F42B 8/12*** | (2006.01) |
| ***F42B 12/02*** | (2006.01) |
| ***F42B 12/08*** | (2006.01) |
| ***F42B 12/74*** | (2006.01) |
| ***F42B 12/76*** | (2006.01) |
| ***F42B 30/02*** | (2006.01) |
| ***F42C 19/08*** | (2006.01) |
| ***F42C 19/10*** | (2006.01) |

(52) U.S. Cl.

CPC ..... *F42C 19/0826* (2013.01); *F42C 19/083* (2013.01); *F42C 19/10* (2013.01)

(56) References Cited

U.S. PATENT DOCUMENTS

| | | | | | |
|---|---|---|---|---|---|
| 4,892,038 | A * | 1/1990 | Lubbers | F42B 12/48 | 102/470 |
| 5,086,703 | A * | 2/1992 | Klein | F42B 5/02 | 102/444 |
| 5,402,729 | A * | 4/1995 | Richert | F41A 11/04 | 102/470 |
| 6,832,557 | B2 * | 12/2004 | Torsten | F42B 5/02 | 102/439 |
| 10,132,601 | B2 * | 11/2018 | Nemec | F42C 19/10 | |
| 11,300,388 | B2 * | 4/2022 | Nemec | F42B 12/02 | |

* cited by examiner

ADVANCED MODULAR AMMUNITION AND CARTRIDGES AND SYSTEMS

BACKGROUND OF THE INVENTION

Field of the Invention

The present invention relates to modular cartridge ammunition for rifle and handguns having reusable cases and projectiles and includes variations for practice, training, and self-defense. The present invention also relates to systems of such modular cartridge ammunition.

Background of the Art

Ammunition for rifles and handguns—collectively referred to herein as "small arms"—is modernly provided in the form of cartridges. Although cartridges come in many configurations and sizes, a typical center-fire cartridge 100 is show in cross-section in FIG. 1.

The cartridge 100 includes a projectile 102 (which is commonly referred to as a "bullet"), an expansive case 104 (which is commonly referred to as a "casing" or a "shell"), propellant 106 (which is commonly referred to as "gun powder"), and a primer 108 (which is commonly referred to as a "cap" or "primer cap"). The projectile 102 is nested in a cavity at the discharge end 110 of the case 104 and held in place by circumferentially crimping the wall 112 of the case 104 against the projectile 102. The primer 108 is press-fit into a primer-receiving cavity 114 at the striking end 116 of the case 104. A small passageway called a flash-hole 118 extends through the end wall of the primer-receiving cavity 114 to provide communication between the primer-receiving cavity 114 and the propellant 106. A flanged rim 120 extends circumferentially around the striking end 116 of the case 104 to help seat the cartridge 100 in the breech chamber of the small arm in which it is to be used. The exterior of the cartridge 100 is sized to fit into the small arm with which it is intended to be used and to provide predetermined levels of gas sealing during firing.

To fire the cartridge 100, it is first loaded into the breech chamber of the small arm and then locked into place. Pulling the trigger of the small arm causes a firing pin to strike against the striking end of the primer 108 to produce a concussion which causes the pressure-sensitive explosive which is contained within the primer 108 to explode. The hot gases and sparks produced by the explosion travel through the flash-hole 118 and ignite the propellant 106 which rapidly conflagrates to produce a high pressure gas pulse against the base 122 of the projectile 102 while causing the casing 104 to radially expand thus loosening its connection with the projectile 102. Propelled by the high pressure gas pulse, the projectile 102 is accelerated to high speed as it travels through and out of the barrel of the small arm. The reactive force that corresponds to discharge of the projectile 102 pushes the small arm backwards toward the shooter. A portion of this reactive force is used in many small arms to operate a mechanism that removes the now empty case 104 from the small arm's breech and inserts another cartridge in its place ready for firing.

Small arms ammunition cartridges are typically machine assembled. The primers and projectiles are typically designed for one-time use while the cases are often reconditioned and reused in machine-assembled cartridges or in user-reloaded cartridges assembled using hand-operated presses.

For a given small arm, the amount of propellant and the design and type of the projectile are selected based upon the intended use of the shooter. For uses in which lethal force is desired, cartridges having heavy projectiles which are accelerated to high muzzle velocities by large amounts of propellants and high pressure primers are often chosen. For target practice and training uses, light, round-tip projectiles are typically used and the amount of propellant may be reduced or even eliminated altogether to lower the muzzle velocity of the projectile. In some training uses, even the projectile is eliminated. Thus, since each kind of shooting use is best satisfied by a cartridge having characteristics tailored to that use, a wide variety of cartridges are available for the typical small arm. However, it is costly to acquire and stock a variety of cartridges for a variety of uses.

As is discussed in more detail in the Summary of the Invention and the Detailed Description of Preferred Embodiments sections below, the present invention makes small arm cartridge ammunition more affordable by providing modular cartridges that may be hand-assembled by the ultimate user. Although there have been many attempts in the past to satisfy this long-felt need of lower-cost user-assembled cartridge ammunition, none of the attempts have yielded all of the advantages which are produced by the present invention. In general, each of the previous attempts provided a single type of cartridge which was useful only for short-range target practice. In contrast, the present invention provides a wide variety of cartridges to satisfy a wide variety of uses. A few of the more notable previous attempts will now be discussed in the chronological order of their development.

In 1880, U.S. Pat. No. 228,494 was issued to B. E. Valentine for a 0.50 caliber or larger rifle cartridge that was suited for training purpose and short ranges. The cartridge is described therein as a "compound cartridge" because it consisted of an outer case that was sized to fit the rifle breech chamber and an inner case that was inserted into the striking end of the outer case. The inner case was a smaller caliber blank cartridge. No propellant was used other than that which was contained in the blank cartridge. It was not necessary to fix the projectile into the cartridge and the projectile could even be loaded through the muzzle end of the rifle after the compound casing had been breech loaded into the rifle. If a space was left between the end of the inner case and the base of the projectile, sawdust or wads of pasteboard or felt could be placed therebetween.

In 1904, Great Britain Patent No. 10,288 was issued to W. H. Trask for rifle cartridge that consisted of an outer case which was dimensioned to fit the rifle chamber. The outer case had a recess at its striking end for receiving an inner case in the form of a blank cartridge which was to be "inserted with the thumb and fingers, and pressed home as far as it would go." No propellant was to be used other than that which was contained in the blank cartridge. A short lead projectile was to be inserted in the firing end of the outer case "with the fingers." The cartridge was "best suited for the usual indoor range of 25 to 50 yards" but was said to provide "splendid shooting" at up to 100 yards or more. Nonetheless, it is clear from the small powder charge and the small projectile that this cartridge was suitable only for target practice.

In 1933, U.S. Pat. No. 1,902,771 was issued to A. F. Gaidos for a "practice cartridge" which was described as being preferably used "in short range target practice or small game hunting." Actually, Gaidos disclosed two different small arms cartridge designs (plus a third for use with a "small cannon"). The first cartridge design was similar to the cartridges of Valentine and Trask mentioned above, in that it used an outer case that fitted the gun's breech chamber and an inner case which comprised a blank that was fitted by hand into a recess of the outer case. This cartridge used no propellant other than that contained in the blank cartridge. The projectile could be seated by hand into the outer case using an alignment fixture. Gaidos' second cartridge design was like the conventional cartridge 2 of FIG. 1 as described above in all respects except two. The first was that it had a two-piece case consisting of a first piece which was hollow and generally cylindrical and a second striking end closure piece that threaded onto the forward piece. The closure end piece had a recess which held a primer. This cartridge was assembled by introducing a projectile having a flared base into the rear open end of the forward piece of the case and sliding the projectile through forward piece until it seated against an internal shoulder of the forward piece. The hollow of the forward piece could then be loaded with a desired amount of propellant. Finally, the closure piece was screwed onto the end of the forward piece of the case.

In 1959, U.S. Pat. No. 3,060,856 was issued to J. S. Dunn for a "practice round of ammunition." Dunn's cartridge used only a primer as its source of projectile propelling force. Externally, the case of the cartridge was sized to fit the breech chamber in which it was to be used. Internally, the case had a first chamber for receiving the straight-walled narrow neck of a shouldered projectile, a second chamber for receiving a primer, and a narrow venturi beveled outwardly at both ends which was situated between the first and second chambers. The second chamber had on its striking end side a snap rim to hold the primer in place. No propellant was used. Both the case and the projectile were made of a moldable plastic. The projectile was to be somewhat softer than the case to facilitate the insertion and sealing of the projectile in the case. The projectile was said to be "reusable for about fifty shots without requiring extensive recovery operations or the use of special tools thereon." The primer was to be inserted and removed with an awl or ice pick.

In 1983, U.S. Pat. No. 4,391,199 was issued to L. Morin for "safe ammunition for exhibition and target shooting." The ammunition comprised a plastic charge carrier, a holder, and a hollow plastic projectile. The charge carrier nested within the holder and had a central collar that engaged the holder's interior walls. Extending in opposite directions from the central collar was a nose end that had closed cone tip and a tail end which held a primer. The charge carrier also had a cylindrical chamber which extended between its tail and nose ends for holding a desired amount propellant. The charge carrier's nose nested within the hollow rear end of the projectile and connected the charge carrier to the projectile. During a shot, the charge carrier's nose split off along fracture line at the charge carrier's collar and was carried away with the projectile while the rest of the charge carrier remained in the gun with the base. The projectile was said to be reusable one time.

In 1993, U.S. Pat. No. 5,259,319 was issued to R. Devecky et al. for "reusable training ammunition." Although described to be used with 37 millimeter gas guns and 40 millimeter grenade launchers rather than small arms, mention is made here of this ammunition because of some features it shares with the hand-reloadable ammunition described above. Like the cartridges of Valentine and Trask, and the first cartridge design of Gaidos, the Devecky et al. cartridge used an outer case that fitted the breech chamber for which it was intended and an inner case which comprised a blank cartridge that was fitted by hand into a recess of the outer case and made use of no propellant other than that which was contained in the blank cartridge. Internally, the Devecky et al. outer case had four straight-walled interconnecting shouldered cylindrical chambers of decreasing radius which were interposed between its firing end and its blank-receiving recess. The projectile had hollow cylindrical chamber running from its tail end forward for about two-thirds of its length. The projectile had a three-step neck at its tail end. The first step was a short steep-angle bevel, the second step was a long shallow-angle bevel, and the third step was a short flat cylinder which stopped at the shoulder formed by the bottom of the forward section of the projectile. These steps permitted the neck to nest within the outer case's interconnecting chambers of decreasing radius without engaging their walls or the shoulders at their junctions. An o-ring was seated on the neck in a groove at the intersection of the second and third steps. This o-ring provided a seal and a resilient connection between the outer case and the projectile. Optionally, an o-ring groove could be provided in the inside wall of the outer case for receiving the o-ring when the projectile neck was properly nested with the outer case. Also, optionally, one or more o-rings could be seated in o-ring grooves on the forward portion of the projectile so as to act as "spin rings" which would engage rifling grooves of the gun's barrel as the projectile traveled down the barrel after being shot away from the case. The case and projectile were to be made of durable impact-resistant materials so as to be reusable.

SUMMARY OF THE INVENTION

The present invention provides reusable ammunition for rifles and handguns in the form of modular cartridges that can be initially assembled, disassembled, and reprocessed by hand in which the cartridge case is suitable for use with a variety of projectile designs and weights and for use with a range of propellant amounts and primer types. The variety of projectiles and range of propelling forces permits the present invention to provide cartridges for all types of uses, including indoor and outdoor target shooting, training, non-lethal self-protection, and lethal uses.

The cartridges of the present invention are of a unique design which, in addition to a case, a projectile, a primer, and a selectable amount of propellant, comprise a novel component which is referred to herein as a "primer housing insert" and which is configured to be releasably attached to the striking end of the case.

Externally, the primer housing insert has an elongated, generally cylindrical shape which is adapted proximal to its striking end to releasably connect to the cartridge case. Internally, the primer housing insert includes a primer cavity that is sized for receiving and retaining a selected primer. A communicating chamber (i.e., a passageway) extends from the primer cavity along the length of the primer housing insert to its discharge end. The geometry of the communicating chamber is selectively configured according the use the cartridge is to be put into which the primer housing insert is assembled. In some embodiments of the present invention, the primer housing insert may be of a one piece construction, while in others, it may comprise an outer section and an inner section. A one-piece construction is preferred in instances wherein the primer housing insert contains only a primer and a two-piece construction is preferred when a propellant is used in addition to the primer.

The present invention also provides a variety of reusable-projectile designs for use as part of its cartridges. The design and materials of construction are selected based upon the intended use of the cartridge.

The present invention also provides systems of modular cartridge ammunition. The systems comprise, for a given small arm, one or more cases into which can be fixed projectiles of different designs and a variety of primer housing inserts having a range of propelling force potential.

BRIEF DESCRIPTION OF THE DRAWINGS

The criticality of the features and merits of the present invention will be better understood by reference to the attached drawings. It is to be understood, however, that the drawings are designed for the purpose of illustration only and not as a definition of the limits of the present invention. Unless otherwise specified, the drawings are not to scale.

FIG. 2A is a side elevational view of the first pistol cartridge of FIG. 2A.

FIG. 2B is a bottom view of the first pistol cartridge of FIG. 2A.

FIG. 2C is an exploded perspective view of the first pistol cartridge of FIG. 2A.

FIG. 2D is a centerline longitudinal view of the first pistol cartridge of FIG. 2A.

FIG. 2E is a centerline longitudinal cross-sectional view of the first pistol cartridge of FIG. 2A.

FIG. 2F is a partially cut-away perspective view of the first pistol cartridge of FIG. 2A.

DETAILED DESCRIPTION OF PREFERRED EMBODIMENTS

In this section, some preferred embodiments of the present invention are described in detail sufficient for one skilled in the art to practice the present invention. It is to be understood, however, that the fact that a limited number of preferred embodiments are described herein does not in any way limit the scope of the present invention as set forth in the appended claims. It is also to be understood that whenever a range of values is presented, the range is to be construed as disclosing its endpoints and every point therebetween as if each point was expressly described.

The present invention provides modular, hand-assembly cartridges for pistols, revolvers, and rifles. Several preferred embodiments are described in this section, with examples being given of pistol cartridges, revolver cartridges, and rifle cartridges. Additionally, for each particular type of pistol, revolver, and rifle, the present invention provides for a variety of different modular components which can be assembled to produce a cartridge that is tailored to the particular type of use the shooter desires, including indoor and outdoor target shooting, training, and self-protection uses.

FIGS. 2A-F show a first pistol cartridge 200 according to an embodiment of the present invention. The cartridge 200 is configured for use in indoor or outdoor target shooting and small game hunting.

Figure 1:
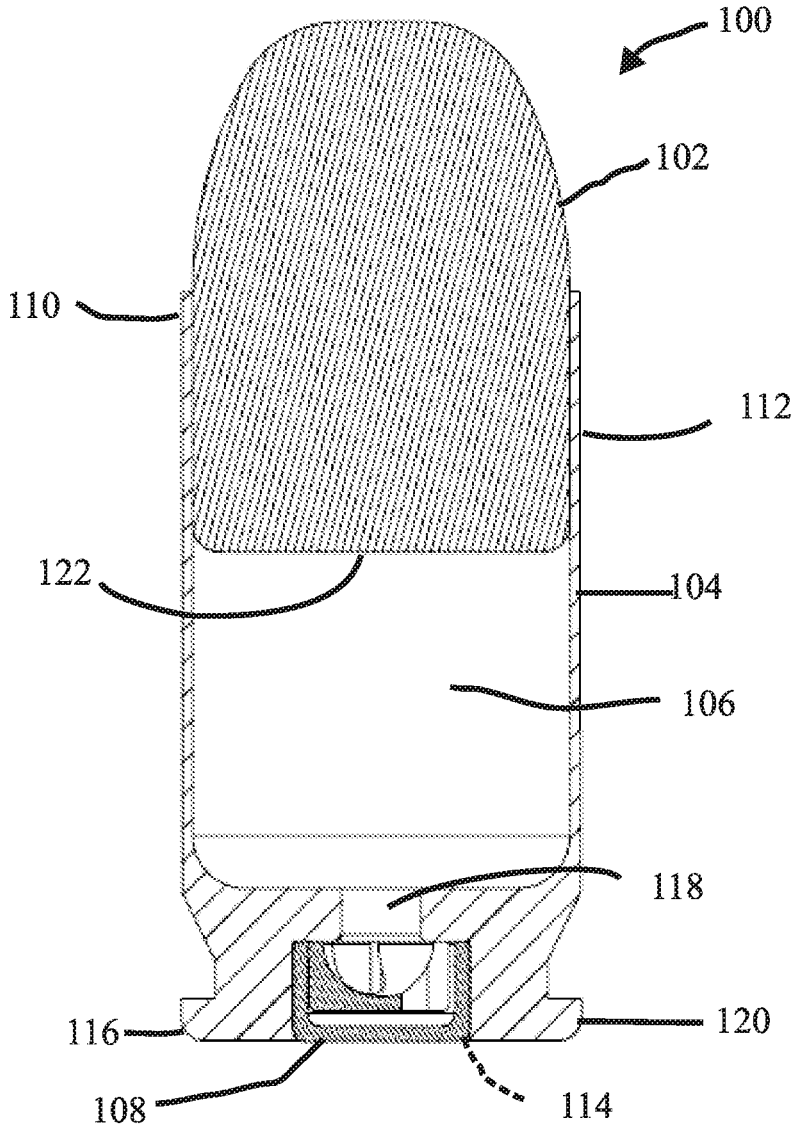
FIG. 1 (PRIOR ART)
FIG. 1 is a centerline longitudinal cross-sectional view of a typical prior art cartridge.
Figure 2A:
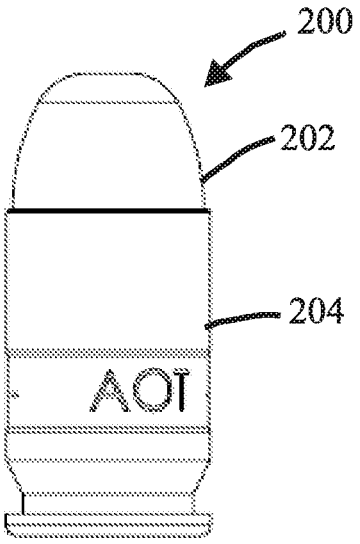
FIGS. 2A-F show a first pistol cartridge according to an embodiment of the present invention.
Figure 2B:
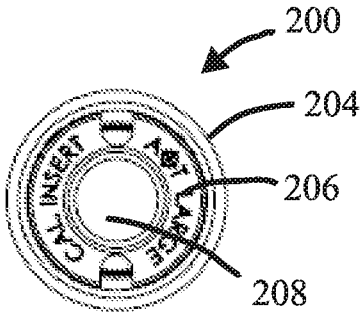
Figure 2C:
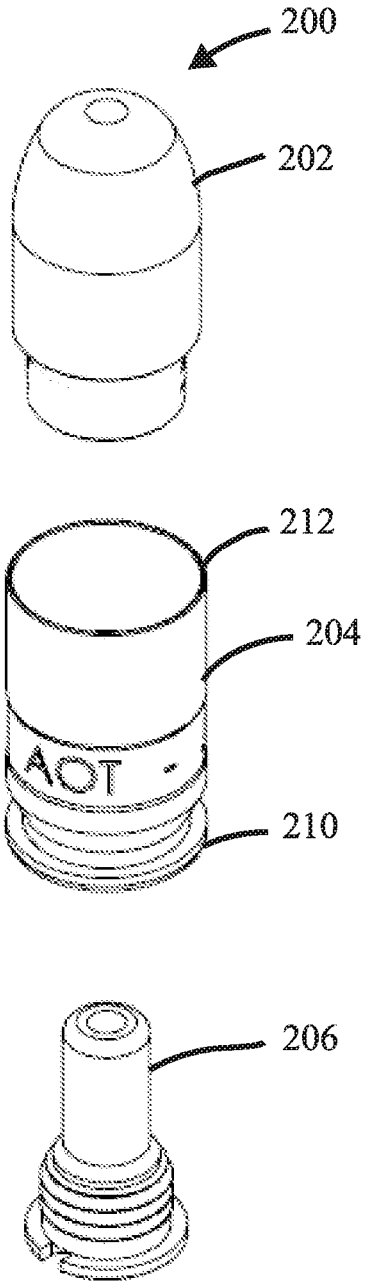

FIGS. 2A and 2B are, respectively, a side elevational view and a bottom (striking end) view of the assembled cartridge 200. In FIG. 2A the projectile 202 and the case 204 of the cartridge 200 are visible. In FIG. 2B, portions of the case 204, the primer housing insert 206, and the primer 208 are visible. FIG. 2C is an exploded perspective view of the cartridge 200 which shows the three primary components of the cartridge 200, i.e., the primer housing insert 206, the case 204, and the projectile 202, prior to the components being hand-assembled by the user to construct the cartridge 200. To make the assembly, the user simply manually nests and rotationally seats the primer housing insert 206 into the striking end 210 of the case 204 and manually seats the projectile 202 into the discharge end 212 of the case 204. The exterior geometries of the case 204 and the projectile 202 are adapted to conform to the one or more breech chambers in which the cartridge the cartridge 200 is intended to be used.

Figure 2D:
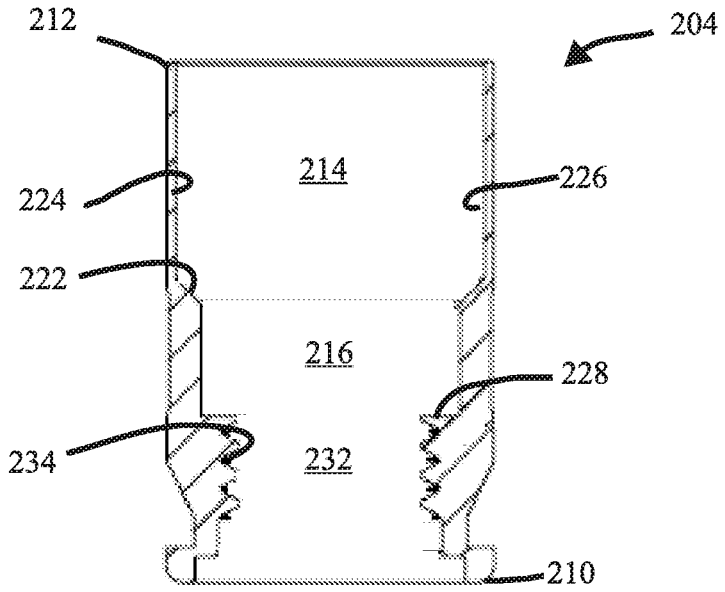
Figure 2E:
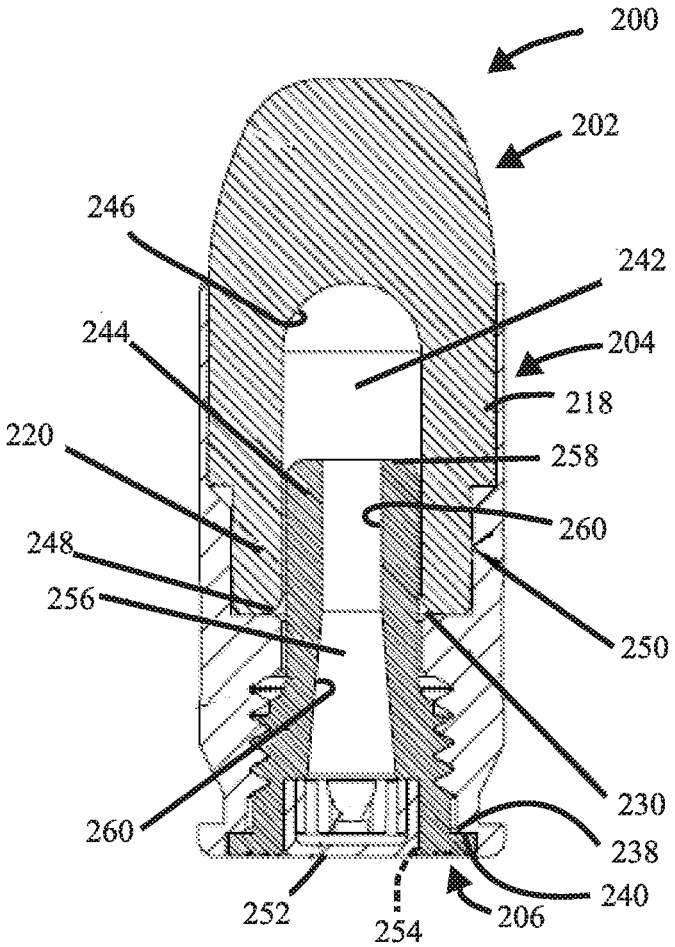
Figure 2F:
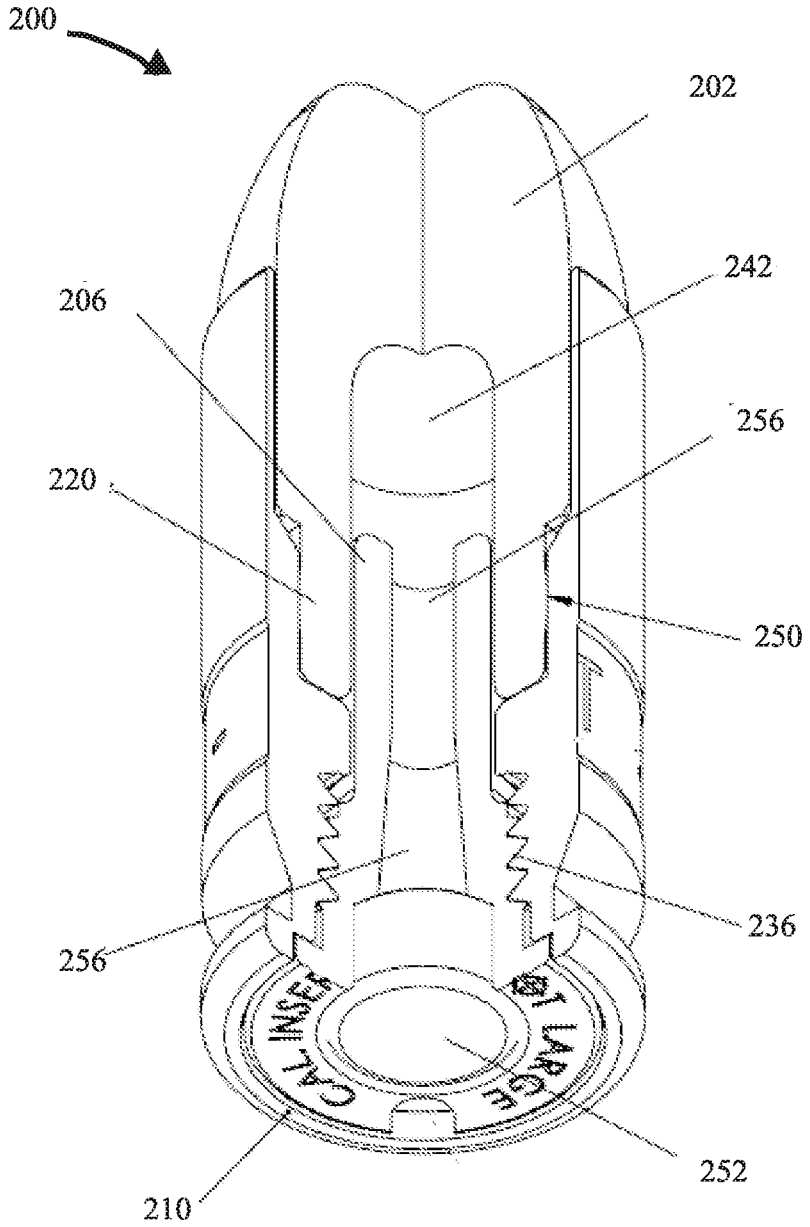

For an understanding of the interior configuration of the cartridge 200, refer now to FIG. 2D, which is a centerline longitudinal view of case 204 and to FIGS. 2E and 2F, which are, respectively, a centerline longitudinal cross-sectional view and a partially cut-away perspective view of the cartridge 200. The following discussion of the interior configuration of the cartridge 200 will start with a description of the case 204 and then progressively proceed to descriptions of the projectile 202 and the primer housing insert 206.

The case 204 has at its discharge end 212 a first cavity 214 (also called an "upper retaining pocket") and a second cavity 216 (also called a "base pocket") which are adapted to nestingly receive the intermediate and base (or neck) portions 218, 220 of the projectile 202. Preferably, the shoulder 222 that is formed between the first and second cavities 214, 216 is beveled inward to help guide the projectile base 220 as it passes from the first to second cavities 214, 216 when the projectile 202 is being inserted into the case 204. The walls 224, 226, respectively, of the first and second cavities 214, 216 are preferably straight (as shown), but either or both of them may be partly or wholly tapered inward if desired to accommodate a similarly tapered projectile. A seating shoulder 228 is at the end of the second cavity 216 to accommodate the endface 230 of the projectile base 220.

Between the second cavity 216 and the striking end 210 of the case 204, the interior of the case 204 has a passageway 232 (also called a "lower retaining pocket") the sides of which are configured to accommodate the outer geometry of the primer housing insert 206. These accommodations include threads 234 to engage the corresponding threads 236 of the primer housing insert 206 and a seating shoulder 238 against which a complimentary shoulder 240 of the primer housing insert 206 seats.

The projectile 202 has a pressure chamber 242 extending along its longitudinal centerline from its base end. The pressure chamber 242 is dimensioned to nestingly receive the post 244 of the primer housing insert 206 so that the post 244 extends into the thick-walled intermediate portion 218 of the projectile 202. The pressure chamber 242 is thus positioned to receive and dimensioned to accommodate the hot gas pressure pulse that is provided by the primer housing insert 206 during firing. The dimensions of pressure chamber 242 also are chosen to promote the balanced and stable flight of the projectile 204. The endwall 246 of the pressure chamber 242 may be of any configuration, e. g. flat, conical, etc., but is preferably domed so as to evenly distribute the pressure pulse to the projectile 202. The corner 248 of the pressure chamber 242 where the pressure chamber 242 terminates at the endface 230 of the base 220 may be squared, but is preferably rounded or beveled so as to help guide the primer housing insert post 244 as it is introduced into the pressure chamber 242.

The projectile 202 is releasably held seated within the first and second chambers 214, 216 of the case 204 by the elastic force exerted by one or more slightly raised circumferential bands (which are referred to herein as "pressure bands", e.g. pressure band 250) against at least one of the interior walls 224, 226 of the first and second chambers 214, 216, respectively.

The primer housing insert 206 has a primer 252 releasably retained within a primer-receiving cavity 254. A passageway 256 extends axially from the primer-receiving cavity 254 to the discharge end 258 of the primer housing insert 206. The walls 260 of the passageway 256 may be straight or may be tapered inwardly along all or a portion of the length of the passageway 256. Optionally, the geometry of the walls 260 of the passageway 256 may take on other configurations so long as the walls 260 are designed to safely contain the hot gas pressure pulse that the passageway 256 is exposed to during the firing of the cartridge 200.

With the exception of the primer 208, all of the components of the cartridge 200 may be constructed of a synthetic material, e.g., injectable plastic. Alternatively, the case, the projectile, and/or the primer housing insert may be constructed in whole or in part of a metal, e.g., brass, aluminum, or copper, to name a few.

Figure 3:
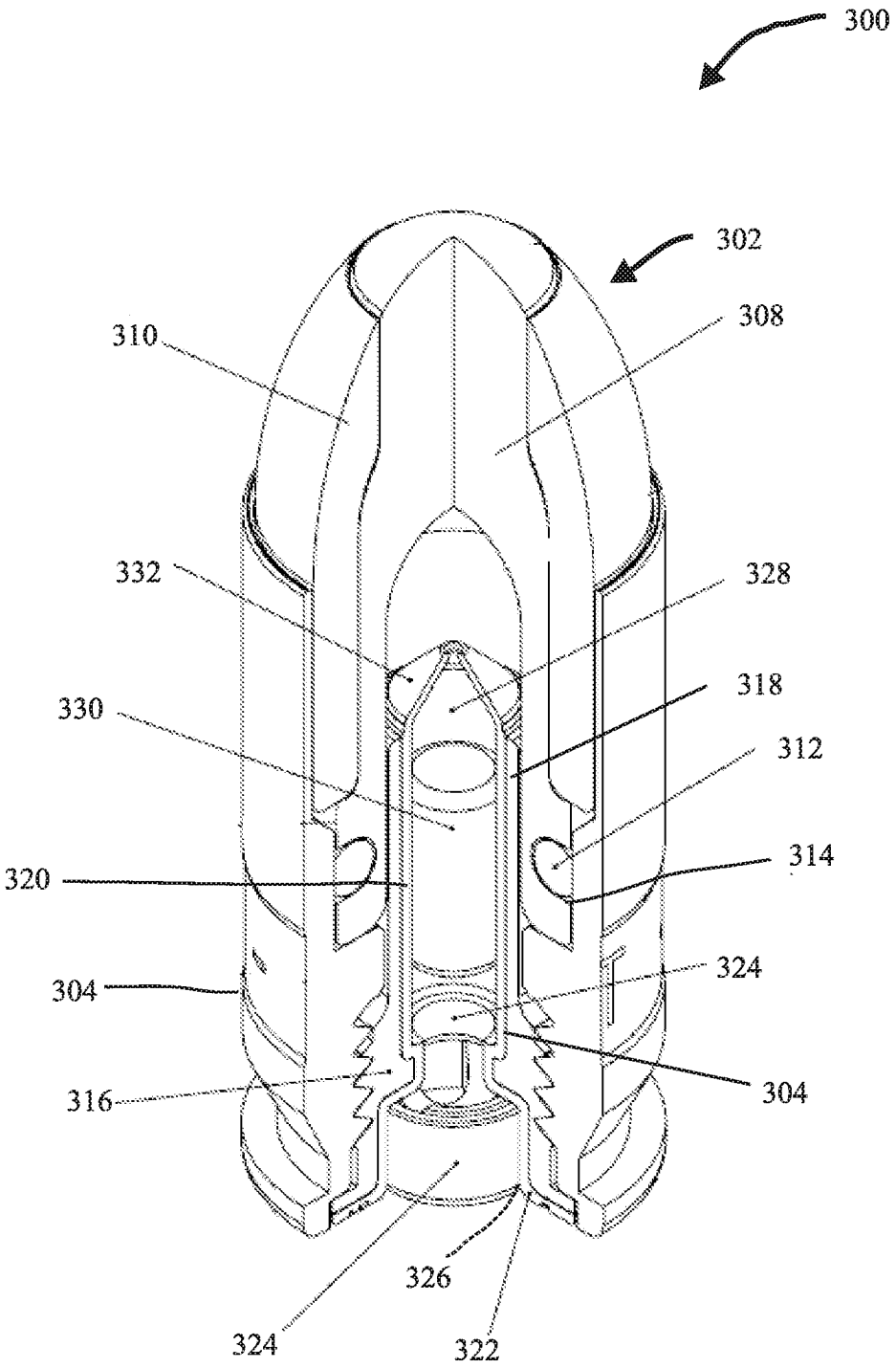
FIG. 3 is a partially cross-sectional perspective view of a second pistol cartridge according to an embodiment of the present invention.

A second pistol cartridge 300 according to an embodiment of the present invention that is suitable for use self protection is shown in a partially cross-sectional perspective view in FIG. 3. Like the first pistol cartridge 200, the second pistol cartridge 300 comprises three main components, namely a projectile 302, a casing 304, and a primer housing insert 306. Also like the first pistol cartridge 200, all of the components of the second pistol cartridge 300 are resusable—except of course for the spent primer and propellant (if any). However, the second cartridge 300 differs from the first cartridge 200 in three main respects.

First, whereas the projectile 202 is a single piece component, the projectile 302 comprises a metal core 308 and a synthetic outer sleeve 310. The metal core 308 provides for additional weight, impact force, and penetration.

Second, in place of the pressure band 250 of projectile 202, the projectile 302 has an o-ring 312 seated in an o-ring groove 314 on the outer surface of its inner core 308 for holding and sealing the projectile 302 in place in the case 304.

Third, the configuration of primer housing insert 306 is more complex than that of the primer housing insert 206. The primer housing insert 306 includes an outer shell that is similar exteriorly to the primer housing insert 206 as it has threads 316 and a post 318 and is preferably made of a synthetic material. However, the inner configuration of the primer housing insert 306 is different in that it contains a metal liner 320. The metal liner 320 has an outer flange 322 that forms the striking end endface of the primer housing insert 306. The metal liner 320 also has a primer 324, which is removably retained within a primer-receiving cavity 326, and a passageway 328 extending from the primer-receiving cavity 326 to the discharge end of the primer housing insert 306. Although the passageway 328 is adapted to optionally contain loose or pelletized propellant, e.g., such as propellant pellet 330 (which for clarity sake is shown in FIG. 3 as floating in the passageway 328), in some embodiments the passageway 328 contains no propellant. In embodiments in which the passageway 328 does contain a propellant, it is necessary to provide a closure to the discharge end of the passageway 328 which will be dislodged or which will open upon firing so that the hot gas pressure pulse emanating from the primer and/or the propellant can exit the discharge end of the passageway 328. The closure may be made by way of a plug or other dislodgable or burstable (e.g., a membrane of film) obstruction or, as shown in FIG. 3, by crimped closure 332 of the end of the metal liner 320.

Figure 4:
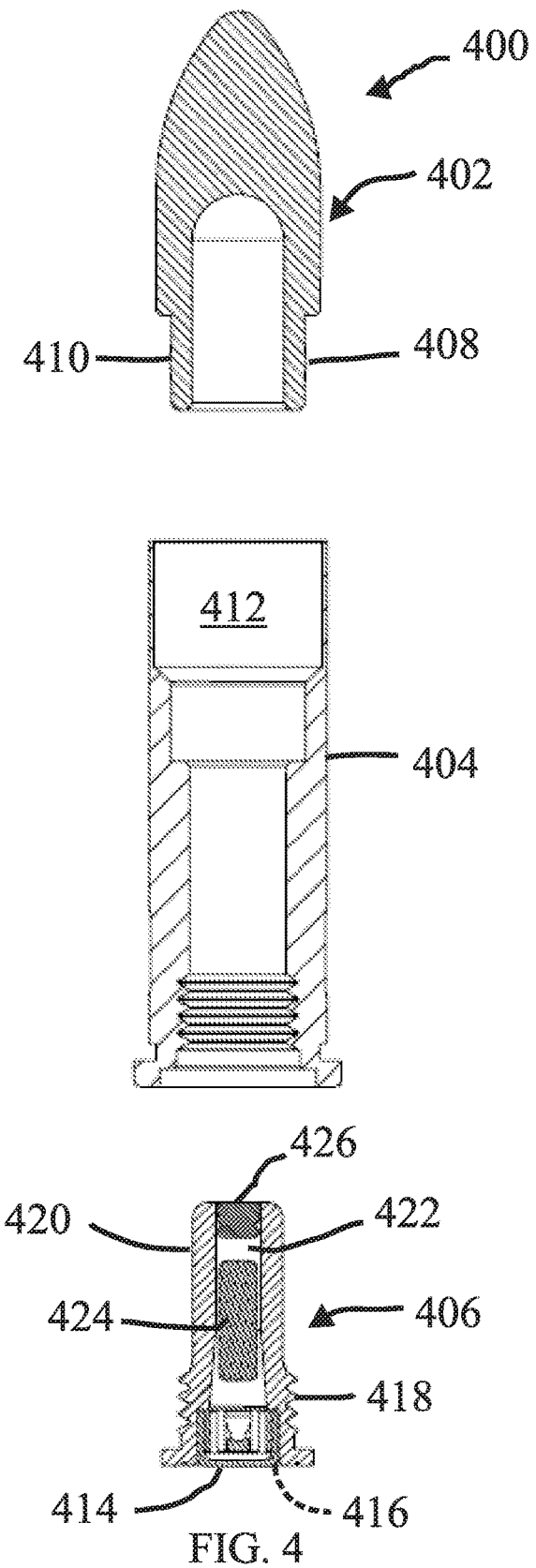
FIG. 4 is an exploded longitudinal cross-sectional view of a first revolver cartridge according to an embodiment of the present invention.

Referring now to FIG. 4, there is shown an exploded longitudinal cross-sectional view of a first revolver cartridge 400 which has a single-piece synthetic projectile 402, a case 404, and a primer housing insert 406. These components are similar to those shown with regard to first pistol cartridge 200. The projectile 402 has a pressure band 408 that aids in sealingly retaining the base 410 of the projectile 402 in the base pocket 412 of the case 404. The case 404 is similar to the base 204 with its features being adapted to the contours and dimensions of the different breech chamber for which it is designed to be used. The synthetic primer housing insert 406 removeably retains a primer 414 in a primer-receiving pocket 416 and has threads 418, a post 420, and a tapered-to-straight passageway 422 which are similar to the corresponding features of primer housing insert 206. However, while the primer housing insert 202 contained only the primer 252, the primer housing insert 406 contains, in addition to the primer 414, a propellant pellet 424 (which for clarity sake are shown in FIG. 4 as floating in the passageway 422), and a retaining plug 426.

Figure 5:
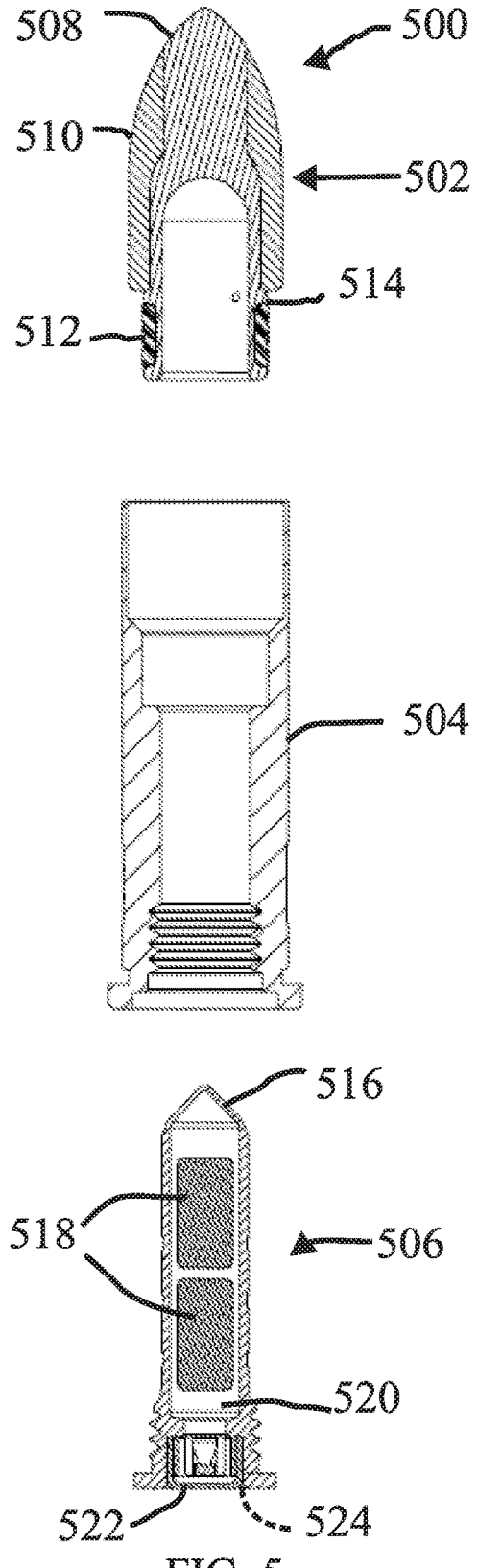
FIG. 5 is an exploded longitudinal cross-sectional view of a second revolver cartridge according to an embodiment of the present invention.

In FIG. 5, a second revolver cartridge 500 according to an embodiment of the present invention is shown as an exploded longitudinal cross-sectional view. The cartridge 500 comprises a two-piece projectile 502, a case 504, and a primer housing insert 506. The projectile 502 has a metal core 508 and a synthetic sleeve 510. An elongated o-ring 512 is seated in a groove on the base 514 of the projectile 502 for sealingly retaining the projectile 502 within the case 504. A small vent hole is provided in the base 514 to help relieve internal air pressure during the assembly of cartridge 500. The case 504 is identical to the case 404. The primer housing insert 506 is metal and has a crimped discharge end 516 to retain loose or pelletized propellant, e.g. propellant pellets 518 (which for clarity sake are shown in FIG. 5 as floating in the passageway 520), and a primer 522 releasably retained within a primer-receiving cavity 524.

Figure 6:
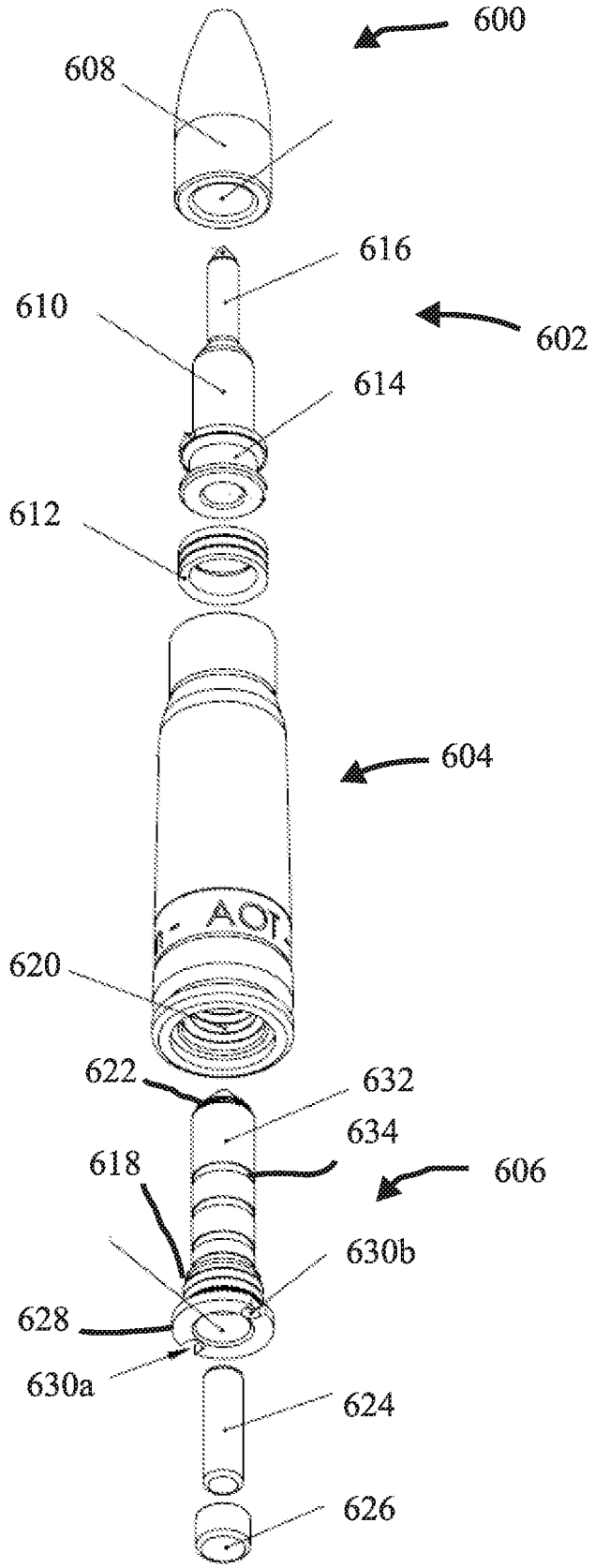
FIG. 6 is an exploded bottom perspective view of a rifle cartridge according to an embodiment of the present invention.

A rifle cartridge 600 according to an embodiment of the present invention is shown in FIG. 6, which is an exploded bottom perspective view showing all of the individual components and subcomponents of the cartridge 600. The main components of the cartridge 600 are a projectile 602, a case 604, and a primer housing insert 606. The subcomponents of the projectile 602 are a sleeve 608, a metal core 610, and an extended o-ring 612. An o-ring groove 614 is provided in the metal core 610 for receiving the o-ring 612. A small vent hole 616 is also provided in the metal core 610. The metal primer housing insert 606 has threads 618 which are adapted to screw into complementary threads 620 of the case 604. The discharge end 622 of the primer housing insert 606 is crimped closed. The primer housing insert 606 has as its subcomponents a propellant 624 and a primer 626. Note that the flange 628 on the striking end of the primer house insert 606 has two recesses 630*a*, 630*b* that allow for a rod, screwdriver tip, or a spanner tool to be used to help seat and unseat the primer housing insert 606 within case 604. Note that the post 632 of the primer housing insert 606 has optional marking bands 634. The color and number of marking bands 634 are used to readily indicate to the user the amount of propellant (if any) and/or the type of primer 626 that primer housing insert 606 contains.

Figure 7A:
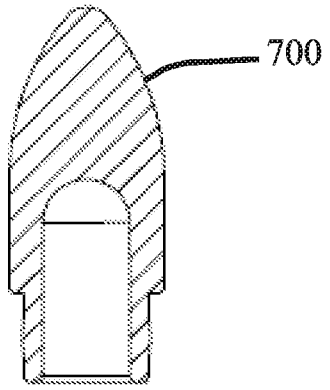
FIGS. 7A-7F are longitudinal centerline cross-sectional views of examples of some of the many types projectile designs that may be used as part of the modular cartridges of the present invention.
Figure 7B:
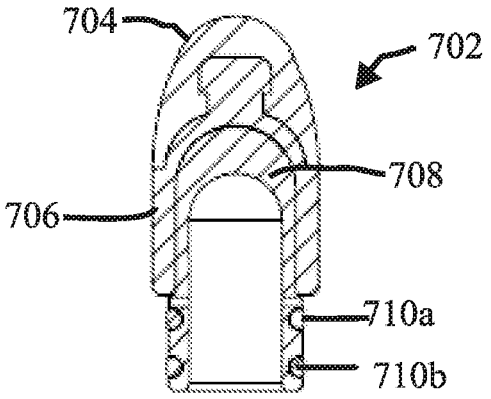
Figure 7C:
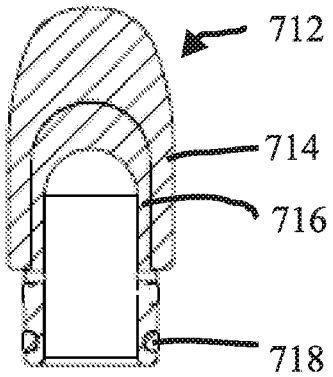
Figure 7D:
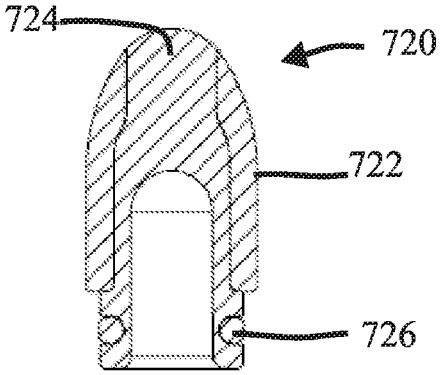
Figure 7E:
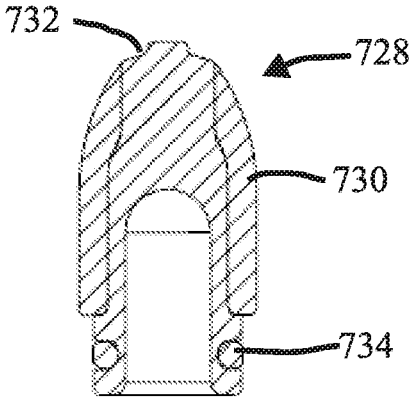
Figure 7F:
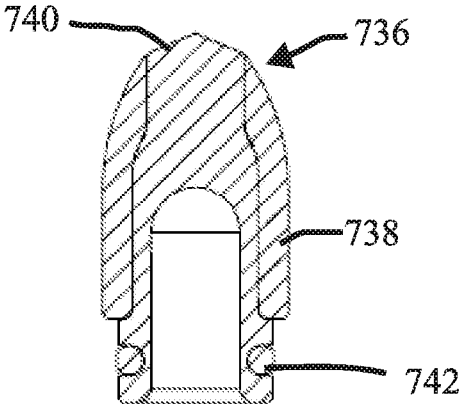

Referring to FIGS. 7A-7F, there are shown longitudinal centerline cross-sectional views of examples of some of the many projectile designs that may be used as part of the modular cartridges of the present invention. FIG. 7A shows a synthetic practice service projectile 700. FIG. 7B shows a training projectile 702 which has a rubber cap 704, a synthetic body sleeve 706, and a metal core 708 which has two groove-seated o-rings 710*a*, 710*b*. FIG. 7C shows a training projectile 712 which has a synthetic body sleeve 714 and a metal core 716 which has a single o-ring 718. FIG. 7D shows a self-defense projectile 720 which has a synthetic body sleeve 722 and an exposed round-tipped metal core 724 having a single groove-seated o-ring 726. FIG. 7E shows another self-defense projectile 728, this one having a synthetic body sleeve 730, an exposed flat sinter tip metal core 732, and a single groove-seated o-ring 734. Finally, FIG. 7F shows still another self-defense projectile 736 which has a synthetic sleeve 738, an exposed pointed stinger metal core 740, and a single groove-seated o-ring 742.

Figure 8A:
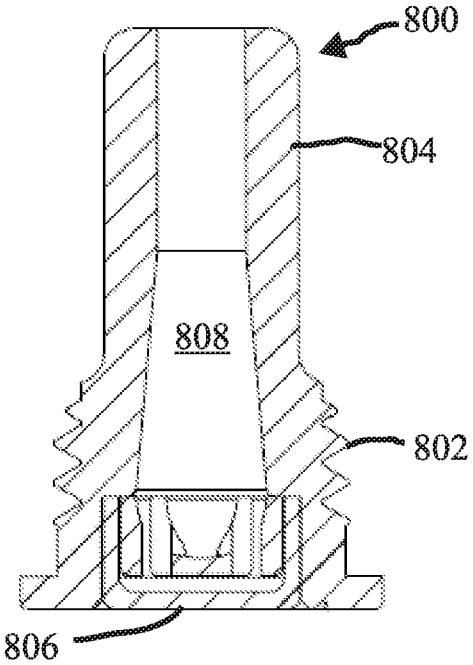
FIGS. 8A-8F are as longitudinal centerline cross-sectional views of some of the configurations that the primer housing inserts of the present invention can have.
Figure 8B:
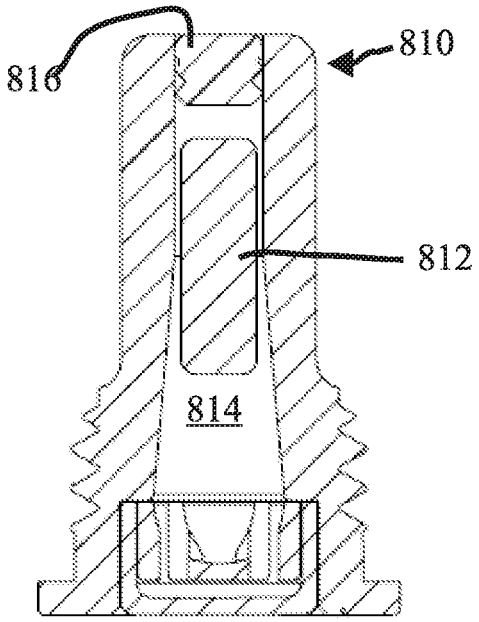
Figure 8C:
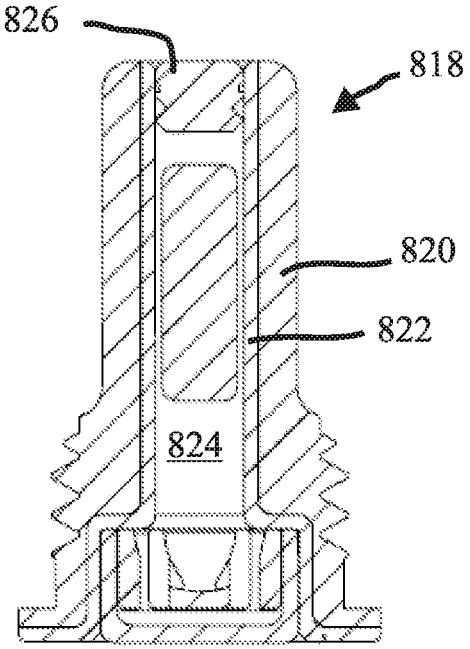
Figure 8D:
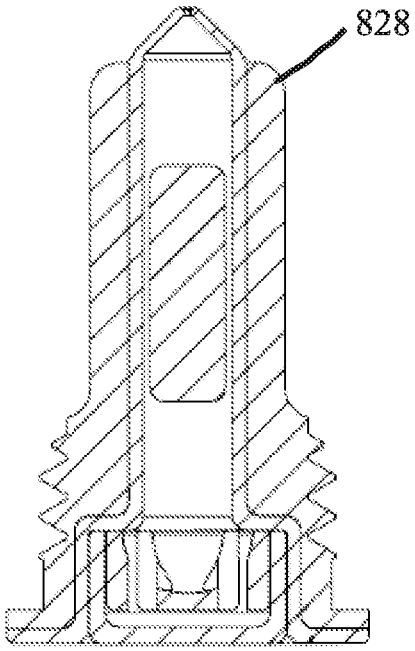
Figure 8E:
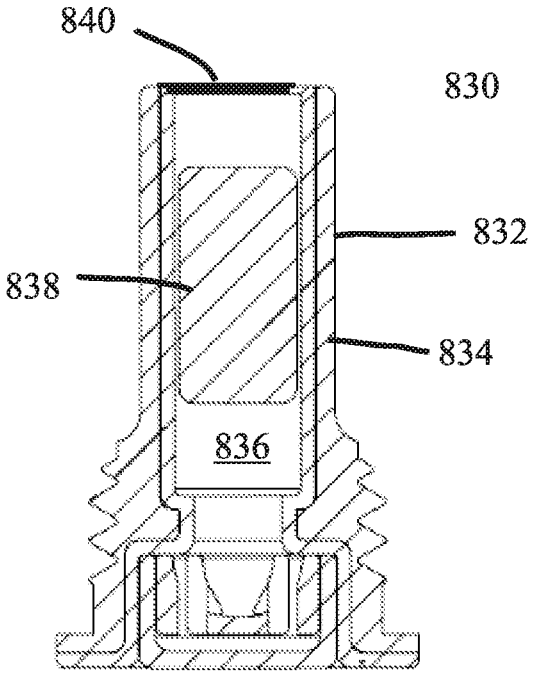
Figure 8F:
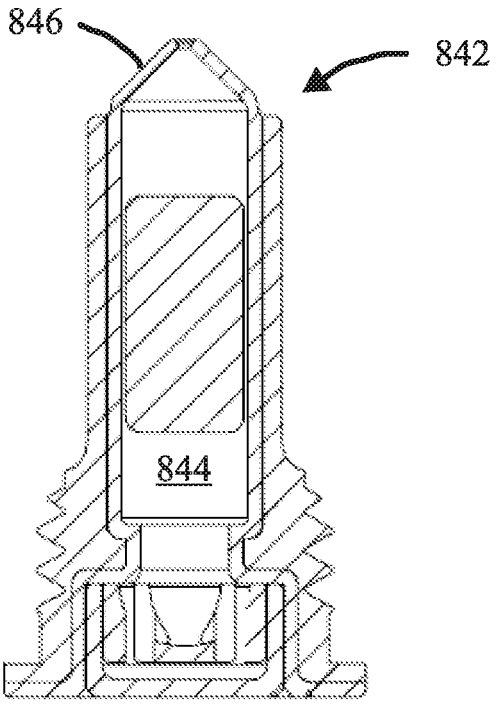

Some of the configurations that the primer housing inserts of the present invention can have are illustrated in FIGS. 8A-8F as longitudinal centerline cross-sectional views. Note that in these figures when propellant is shown, for clarity it is depicted in the form of a floating stylized pellet. Propellant can be in the form of loose powder or as one or more pellets or as a combination of loose powder and pellets. FIG. 8A shows a synthetic body primer housing insert 800 having the configuration already described above for the primer housing insert 206. It includes threads 802, a post 804, a primer 806, and a tapered-to-straight passageway 808. FIG. 8B shows a metal body primer housing insert 810 which has a propellant pellet 812 in its passageway 814 and a plug 816 closing the discharge end of the passageway 814. FIG. 8C shows a two-piece primer housing insert 818 which has a synthetic outer body 820 and a metal liner 822. The primer housing insert 818 is the same as the two-piece primer housing insert 306, except that instead of having a crimped end to its passageway 824, the passageway 824 is sealed with a plug 826. FIG. 8D shows a two-piece primer housing insert 828 which is the same as the two-piece primer housing insert 306. FIG. 8E shows another a two-piece primer housing insert 830 which differs from the two-piece primer housing inserts 818, 828 in three principal respects. First, the post 832 of its outer body 834 has a thinner wall than those of the other two primer housing inserts 818, 828. Second, its passageway 836 is wider than those of the other two primer housing inserts 818, 828 allowing it to contain more propellant 838. Third, instead of using crimping or a plug to close the discharge end of its passageway 836, the primer housing insert 830 uses a thin film 840 for that purpose. FIG. 8F shows another two-piece primer housing insert 842. Primer housing insert 842 is the same as the primer housing insert 830, except that the discharge end of its passageway 844 has a crimped closure 846.

It is to be understood that although some features are described above as part of the description of one or another embodiment of the present invention, the present invention includes adapting the features shown on one embodiment for use on other embodiments. For example, some embodiments described using one or more o-rings to interconnect a projectile to a case while others described using one or more pressure bands for that purpose. The present invention contemplates embodiments which use one or the other or both of those means for interconnecting the projectile and case.

It is also to be understood that it is preferred that all of the components of the modular cartridges of the present invention be made of materials which are environmentally friendly. Nonetheless, the inventor understands that environmentally friendly materials may not be available or affordable under some circumstances and so includes within the scope of the present invention the use of any and all types of materials which are fit on an engineering basis for use in the modular cartridges having the components described herein.

It is also to be understood that any size and kind of primer and propellant that is otherwise suitable for use in a particular small arm may be used in the construction and use of the modular cartridges of the present invention. Also, although only center-fire cartridges are described above, rim-fire cartridges are also within the scope of the present invention and may be constructed by adapting the primer-receiving cavity and the passageway to be sufficiently off-center, at least at the striking end of the cartridge, for the firing pin of the small arm to fire the rimfire primer. Of course, if a particular small arm is adapted for use with both centerfire and rimfire cartridges, then either a centered location or an off-centered location for the rimfire primer may be used.

Cases for use with modular cartridges of the present invention are preferably made from a synthetic material or a metal that is suitable for the pressures and handling that the cartridges are expected to encounter as well as providing a suitable atmospheric seal for avoiding any undesirable degradation of any propellant that the cartridge is to contain.

At the time of the writing of this document, there are well over 500 different kinds of small firearm cartridges, most adapted to fit only the breech chamber of one particular small firearm. The present invention includes modular cartridges adapted for use in all existing small firearms as well as those small firearms that may be later developed. The modular cartridge system allows any particular firearm, the mixing and matching of primer housing inserts and projectiles with the cases adapted for use of that particular firearm, thus greatly simplifying stocking of ammunition. Accordingly, it is to be understood that the present invention includes within its scope systems and methods of operating the systems which include the provision and/or assembly and/or the disassembly of the components of the modular cartridges described herein.

A preferred method of using the modular cartridge system of the present invention is to provide a shooter with the case, the projectile or projectiles of his choice, and the primer housing inserts having the loading and design of his choice, and permitting the shooter to assemble the cartridge himself or herself. It is also within the scope of the present invention that the modular cartridges be provided already assembled to the shooter. In either circumstance, after firing the cartridge, the shooter may recover the projectile for reuse (except in embodiments wherein a single-use projectile was used or a reusuable projectile becomes lost) and remove the primer housing insert from the case and replace it with a fresh primer housing insert and insert into the case along with the original or a different projectile.

A primer housing insert may be reused by dislodging the spent primer from the primer-receiving cavity of the primer housing insert and replacing it with a fresh primer. If the primer housing insert was designed to hold propellant, the propellant may be replaced with the desired amount of fresh propellant which is safe for use in the particular primer housing insert and a suitable closure be made for the discharge end of the primer housing insert passageway. For safety reasons, it is preferred that the fired primer housing inserts be returned to a manufacturer for reconditioning, particularly those which include a propellant and even more particularly, those which used a crimped closure to contain the propellant.

Figure 9:
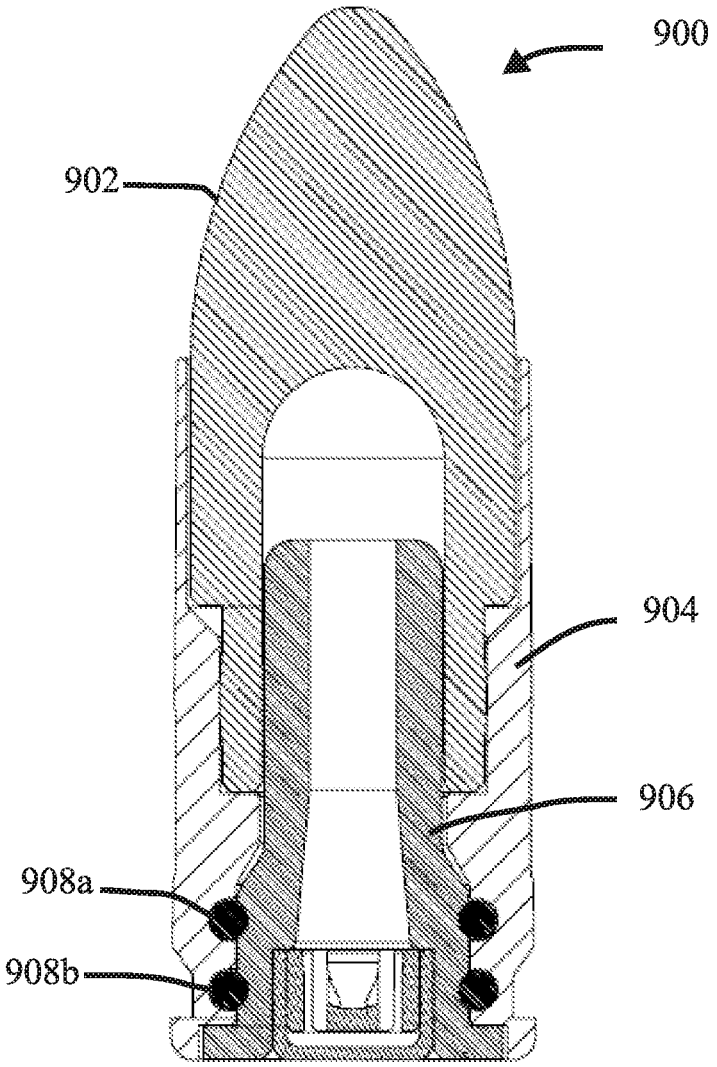
FIG. 9 is a longitudinal centerline cross-sectional view of another pistol cartridge embodiment of the present invention showing an o-ring connection between the case and the primer housing insert.

It should be understood that although the modular cartridges of the present invention described above used a threaded connection for connecting the primer housing insert and the case, other means connections may be used. For example, a bayonet-type connector may be used, e.g., with the primer housing insert having one or more radially-extending projections which fit into complementary grooves of the case so that the primer housing may be seated by a combined rotating-thrust motion. Another connection means is the use of one or more releasable tab and slot combinations. A tab and slot combination optionally may also include the use of grooves for guiding the advance or withdrawal of the tab or tabs into or from the slot or slots. It is also to be understood that where threads are used as the connection means or as part of the connection means, the threads may be of the single-lead or of the multiple-lead type. An example of still another means of connection is shown in FIG. 9 which is a longitudinal centerline cross section of a third pistol cartridge 900 according to an embodiment of the present invention. The cartridge 900 comprises a projectile 902, a case 904, and a primer housing insert 906. The case 902 and the primer housing insert 906 are connected by way of o-rings 908*a*, 908*b* which are seated in complentary o-ring grooves in the case 904 and the primer housing insert 906.

It is also be understood although the primer housing inserts described above contain a discrete primer, it is within the present invention to seat within the primer housing inserts cartridge blanks which contain a primer. In such embodiments, the primer-receiving cavity and the passageway may be combined in whole or in part to accommodate the blank. Such blanks may also include a desired amount propellant.

It is to be understood that although the present invention is preferred for use with small arms, it is within the scope of the present invention that its modular cartridges described above be dimensionally configured for use with cartridges for larger weapons as well. Such cartridges would comprise a casing, a projectile, and a primer housing insert.

It is also to be understood that since the present invention is primarily concerned with providing reusable components, the projectiles are preferably designed for non-lethal uses. However, it is within the scope of the present invention for the modular cartridges to include single-use projectiles that are designed for lethal uses, e.g., those that are designed to expand upon impact. To be sure, it is to be understood that the present invention encompasses the adaptation of all types of projectiles—both recoverable and non-recoverable (including those of lethal design)—for use with the modular cartridges described above.

All patent applications and patents, both foreign and domestic, and all other publications referenced herein are incorporated herein in their entireties to the full extent permitted by law.

What is claimed is:

1. A subassembly for an ammunition cartridge, the subassembly comprising:

a) a reusable case having a forward end and an aft end, the forward end being adapted to releasably attach to a bullet having a forward end and an aft end and a pressure chamber extending from its aft end and the case having an external wall extending from the case's aft end to the case's forward end, the case being adapted for use in at least one of a revolver and a rifle;

b) a primer cap; and c) a reusable primer housing insert having a forward end and an aft end, the primer housing insert being adapted to releasably attach proximal to its aft end to an inside of the case's external wall proximal to the aft end of the case and having a first recess proximal to the primer housing insert's aft end adapted to releasably contain the primer cap and a channel communicating from the first recess to or through the primer housing insert's forward end;

wherein when the subassembly is combined with the bullet to form an ammunition cartridge, the forward end of the primer housing insert extends into the bullet's pressure chamber without connecting to the bullet and the primer housing insert is configured to expel a gas pressure pulse axially through its forward end into the bullet's pressure chamber.

2. The subassembly of claim 1 further comprising a propellant disposed within the channel of the primer housing insert.

3. The subassembly of claim 1 wherein the channel of the primer housing insert has a forward end and the forward end of the channel of the primer housing insert is open.

4. The subassembly of claim 1 wherein the channel of the primer housing insert has a forward end and the forward end of the channel of the primer housing insert is closed.

5. The subassembly of claim 1 wherein the primer housing insert further comprises a synthetic material outer body and a metal liner disposed within the outer body.

6. A component of an ammunition cartridge for at least one of a revolver and a rifle, the ammunition cartridge comprising, in addition to the component, a case having an exterior wall and a bullet, the component comprising a reusable primer housing insert having a forward end and an aft end, the primer housing insert being adapted to releasably attach proximal to its aft end to an inside of the exterior wall of the case proximal to an aft end of the case and having a first recess proximal to its aft end adapted to releasably contain a primer cap and a channel communicating from the first recess to or through the primer housing insert's forward end wherein when the component is combined with the bullet and the case to form the ammunition cartridge, the forward end of the primer housing insert extends into a pressure chamber of the bullet which is proximal to the aft end of the bullet without the primer housing insert connecting to the bullet and the primer housing insert is configured to expel a gas pressure pulse axially through its forward end into the bullet's pressure chamber.

7. The component of claim 6 further comprising a propellant disposed within the channel of the primer housing insert.

8. The component of claim 6 wherein the channel of the primer housing insert has a forward end and the forward end of the channel of the primer housing insert is open.

9. The component of claim 6 wherein the channel of the primer housing insert has a forward end and the forward end of the channel of the primer housing insert is closed.

10. The component of claim 6 wherein the primer housing insert further comprises a synthetic material outer body and a metal liner disposed within the outer body.

11. A system comprising a plurality of modules adapted to be manually combined to form at least one ammunition cartridge for at least one of a revolver and a rifle, the modules including a case having an exterior wall, a bullet, and a reusable primer housing insert, wherein the primer housing insert has a forward end and an aft end and is adapted to releasably attach proximal to its aft end to an inside of the exterior wall of the case proximal to an aft end of the case and has a first recess proximal to its aft end and adapted to releasably contain a primer cap and a channel communicating from the first recess to or through the primer housing insert's forward end wherein when the primer housing insert is combined with the bullet and the case to form the ammunition cartridge, the forward end of the primer housing insert extends into a pressure chamber of the bullet which is proximal to the aft end of the bullet without the primer housing insert connecting to the bullet and the primer housing insert is configured to expel a gas pressure pulse axially through its forward end into the bullet's pressure chamber.

12. The system of claim 11 further comprising a propellant disposed within the channel of the primer housing insert.

13. The system of claim 11 wherein the channel of the primer housing insert has a forward end and the forward end of the channel of the primer housing insert is open.

14. The system of claim 11 wherein the channel of the primer housing insert has a forward end and the forward end of the channel of the primer housing insert is closed.

15. The system of claim 11 wherein the primer housing insert further comprises a synthetic material outer body and a metal liner disposed within the outer body.

16. The system of claim 11 wherein the bullet comprises a body sleeve and a metal core.

17. The system of claim 16 wherein the bullet further comprises rubber cap.

18. The system of claim 16 wherein the metal core has a forward end and the body sleeve encloses the forward end of the metal core.

19. The system of claim 16 wherein the metal core has a forward end and the forward end of the metal core protrudes forward from the body sleeve.

20. The system of claim 11 wherein the bullet has a forward tip and the forward tip is one of rounded, flat, and pointed.

* * * * *